US006779716B1

(12) United States Patent
Grow

(10) Patent No.: US 6,779,716 B1
(45) Date of Patent: Aug. 24, 2004

(54) RIFLED WEAPON ENGRAVER AND SCANNER

(76) Inventor: Ivan W. Grow, 24471 E. 205th St., Ridgeway, MO (US) 64481

( * ) Notice: Subject to any disclaimer, the term of this patent is extended or adjusted under 35 U.S.C. 154(b) by 0 days.

(21) Appl. No.: 10/617,331

(22) Filed: Jul. 10, 2003

(51) Int. Cl.[7] ..... G06F 17/00

(52) U.S. Cl. ..... 235/375; 219/21.68; 42/76.01; 42/78

(58) Field of Search ..... 235/375; 219/121.68; 42/76.01, 78

(56) References Cited

U.S. PATENT DOCUMENTS 3,701,097 A 10/1972 Wolff
4,035,942 A 7/1977 Wiczer
4,175,346 A * 11/1979 Zemsky ..... 42/76.01
5,758,446 A * 6/1998 Atchison ..... 42/78
6,462,302 B1 * 10/2002 Grow ..... 219/121.68

* cited by examiner

*Primary Examiner*—Karl D. Frech
*Assistant Examiner*—Daniel A. Hess
(74) *Attorney, Agent, or Firm*—Chase Law Firm, L.C.

(57) ABSTRACT

A computer-controlled laser etching probe etches a firearm-identifying indicia such as a barcode encoded serial number into the barrel and breech of a bore of a firearm. Owner registration data coupled with the serial number is stored in a central database. A computer-controlled scanner reads the barcode from a slug or casing or a bullet fired from an etched firearm for comparison with registration data in the central database, thereby identifying the registered owner of the firearm from which the bullet was fired. Crime scene data including GPS data identifying the location of the crime, barcoded slugs or casings, registration data associated with the identified firearm, and the last known residence of the registered owner along with derived data may be used to determine a probability map of the location of a criminal suspect.

31 Claims, 14 Drawing Sheets

RIFLED WEAPON ENGRAVER AND SCANNER

BACKGROUND OF THE INVENTION

This invention relates to a method and system for marking the inner surfaces of a firearm with an identifying indicia for transfer to the slug and casing of a bullet when it is fired, reading the indicia from the slug and/or casing and identifying the firearm therefrom and, in particular, to the modification of the inner surfaces of a firearm using a laser for the purpose of producing one or more areas of permanent grooves, which impart firearm data onto slugs passing through the barrel in contact with the inner surface of the barrel and onto casings in contact with the breech of the firearm to form a barcode-like pattern which may be read by a desktop or portable barcode scanner and matched to the firearm and analyzed to provide search data.

In order to link a bullet with the firearm that fired it, it is known in the art to examine a bullet, usually comparatively with another bullet, each with small, irregular microscopically viewable markings imparted during firing to determine a similarity between such markings whereby to support a conclusion that both bullets were fired from the same firearm.

In order to facilitate ballistic identification procedures with only the fired bullet available, various systems have been proposed in which bullets are marked by placing a channeled ring containing a number of dye bars in a groove in the barrel, which impart markings to the bullets which pass over them. The dye bars are assembled in different combinations according to a preset code which corresponds to the firearm's serial number. Other systems have been proposed in which the identifying markings are an integral part of the barrel and bore surface so that they cannot be removed without damaging or disabling the firearm. Among the problems with such systems is that the identifying marking elements must be incorporated during manufacture of the firearm.

Use of a laser to etch the bore of a fire arm is disclosed in U.S. Pat. No. 6,462,302 to Grow discloses a device for etching the bore of a firearm and a scanner for reading the etchings from a slug of a bullet. The laser beam which etches the bore is directed onto a mirror in an etching tube which directs the beam to bore surface.

The laser etching system of the present invention includes a computer controlled laser system adapted to etch the bore and breach of a firearm using an etching probe inserted into the barrel of the firearm. Firearm identifying data, such as a serial number, are etched in both the bore and the breech of the firearm in the form of a barcode or other identifying indicia. Registration data corresponding to the owner of the firearm and the serial number or other firearm identifying data are entered into a computer and transferred to a central database. A slug fired from an etched firearm and the casing are marked with the etched barcode. A computer controlled scanning system reads the barcode and translates it into a serial number or other firearm identifying data for comparison with serial number stored in the central database.

Other advantages of the invention will become apparent from the following description taken in connection with the accompanying drawings, wherein is set forth by way of illustration and example, an embodiment of this invention.

DESCRIPTION OF THE PREFERRED EMBODIMENT

Figure 1:
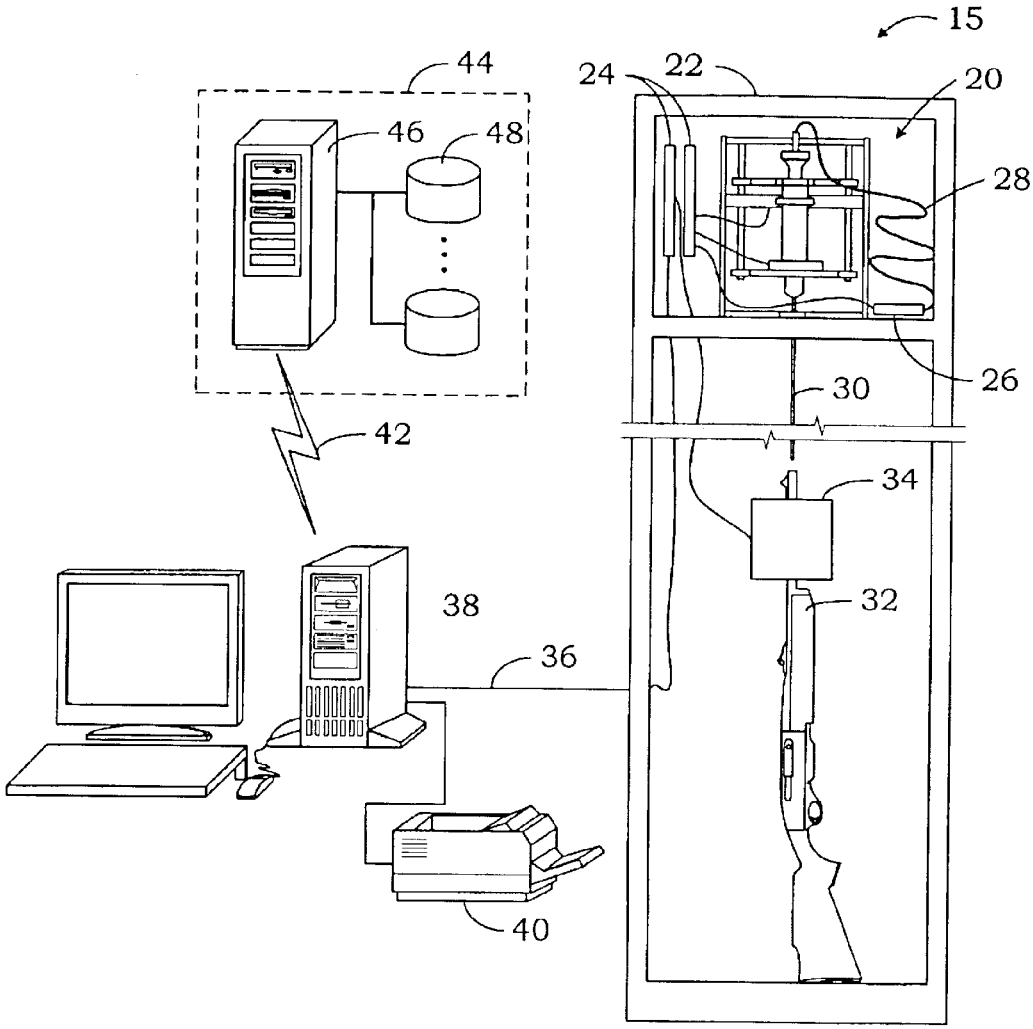
FIG. 1 is diagrammatic view of a prior art barrel-marking system.

Turning more particularly to the drawings, FIG. 1 illustrates a firearm barrel-marking system as disclosed in the U.S. Pat. No. 6,462,302 including a barrel etching assembly 20 shown mounted in cabinet 22. One or more electronic controller boards 24 control the output of laser tube 26 which is connected through optical fiber 28 to etching assembly 20 and the positioning of laser tube 30 to etch the bore of rifle 32 held in clamp 34. It is to be understood that a mirror system may be used in place of optical fiber 28 to direct the output of laser tube 26 to etching assembly 20.

Input and control data is transferred to boards 24 over a control line 36 from computer 38. Computer 38 may be a personal computer with a network or internet connection and an attached printer 40. A serial number and registration data for rifle 32 may be entered into computer 38 which are transferred over line 36 to control boards 24 to be used for input and control parameters. Registration data may be entered into computer 38 transferred from computer 38 through communications link 42 to computer system 44. Computer system 44 may consist of a server 46 and one or more databases 48 to store the firearms registration data. Computer system 44 may be controlled and operated by a federal law enforcement agency such as the FBI for registration and identification of a firearm 32.

Figure 2:
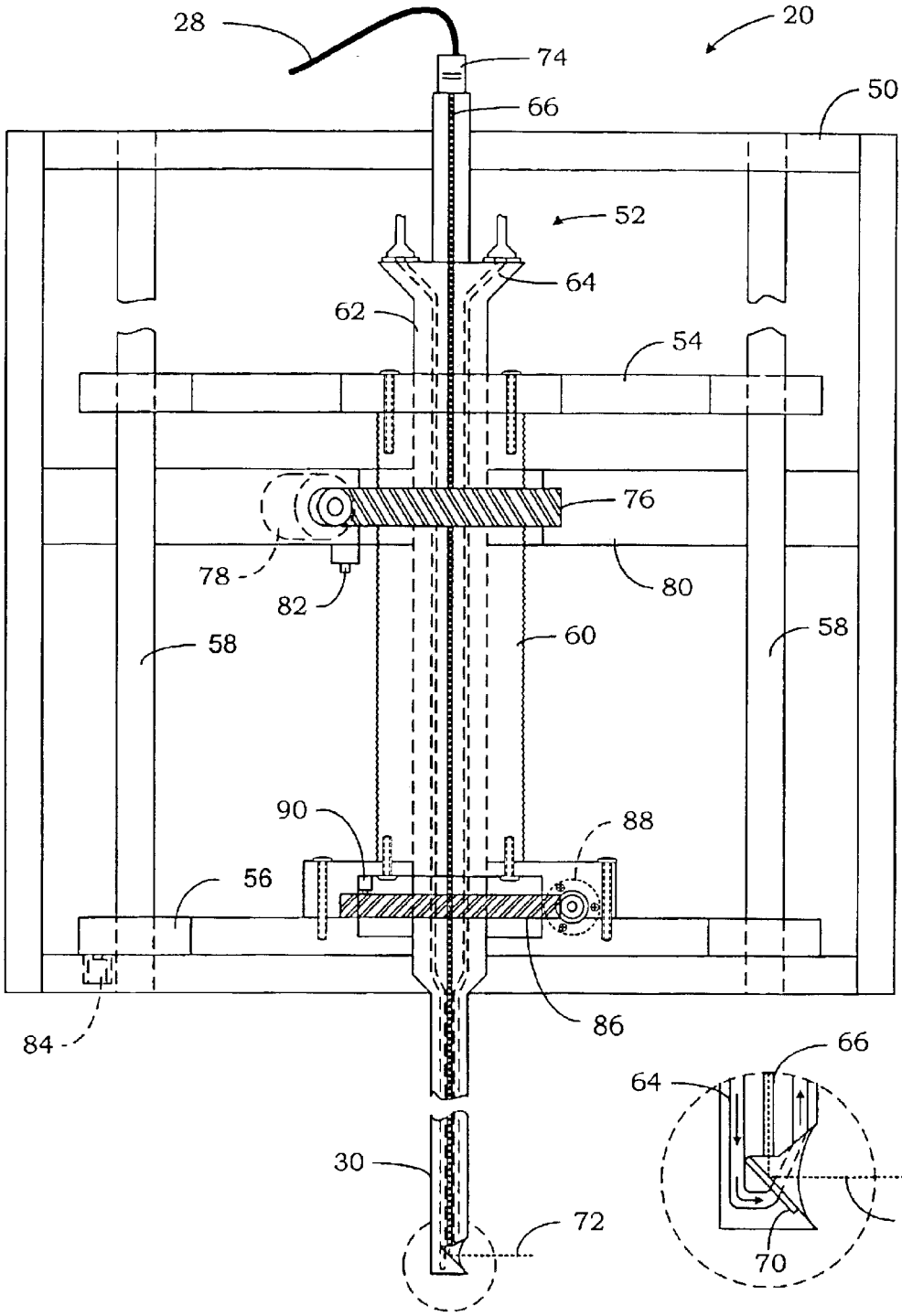
Fig. 2 PRIOR ART
FIG. 2 is a front elevational view of a prior art barrel-marking assembly.
Figure 2A:
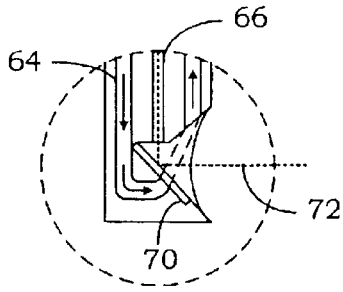
Fig. 2a PRIOR ART
FIG. 2*a* is an enlarged view of the probe tip shown in FIG. 2.

Referring to FIGS. 2 & 2*a*, a prior art laser etching assembly 20 disclosed in U.S. Pat. No. 6,462,302 includes a frame 50 which supports a laser tube assembly 52. The laser tube assembly 52 is secured to upper 54 and lower 56 support cross members which slidably engage guide rods 58.

Laser tube assembly 52 includes a threaded outer cylinder 60 which extends between and is secured to upper 54 and lower 56 support cross members. A reflector positioning tube 62 is rotatably secured within cylinder 60. Reflector positioning tube 62 includes coolant tubing 64, laser tube 66, probe 30 and reflector 70. Laser light 72 is injected into laser tube assembly 52 from fiber optic line 28 through connector 74 into tube 66.

An upper vertical alignment gear 76, which engages the threads of cylinder 60 is controlled by stepper motor 78. Gear 78 is housed in center frame member 80. Limit switches 82 and 84 limit the vertical displacement of laser tube assembly 52 between the center frame 80 and lower of member frame 50. Stepper motor 78 precisely controls the placement of probe 30. Limit switch 84 is also used to indicate when probe 30 is in the starting or default position.

Rotation of laser tube assembly 52 is accomplished by a lower worm gear 86 secured to laser tube assembly 52 and engaged by step motor 88. A limit switch 90 may be used to limit rotation of laser tube assembly 52 to prevent damage to optical fiber 28 and to indicate when laser tube assembly 52 is rotated to the starting or default position.

Figure 3:
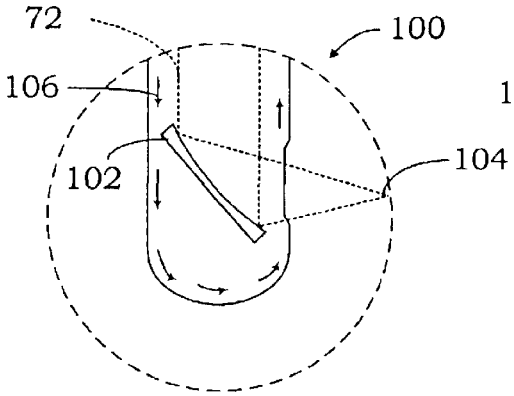
FIG. 3 is an enlarged view of a probe tip of the present invention.
Figure 4:
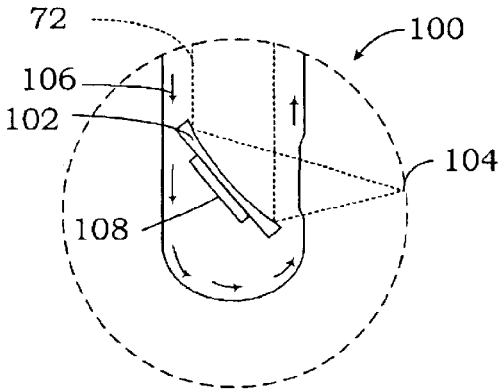
FIG. 4 is an enlarged view of a probe tip of the present invention.

Referring to FIGS. 3 and 4, an improved laser probe is generally indicated by reference numeral 100. Laser probe 100 includes a concentrating reflector or mirror 102. Reflector 102 focuses a relatively broad laser beam 72 to a relatively narrow point 104 at the surface of the bore or breech of a weapon (not shown). The concentrating reflector 102 may be thermally stabilized by cycling fluid or gas 106 around the reflector 102 if necessary, for example. An electrically powered thermocouple 108 may be used in combination with a gas or liquid 106 or alone to cool reflector 106.

The focusing reflector 106 may be made using adaptive optics technologies, a single mechanically distorted reflective surface such as those used in astronomical interferometers, or may be composed of smaller, independently positioned reflectors such as the million mirror chip built by Texas Instruments, for example.

The end of probe 100 may be open to allow cooling gas or liquid 106 to escape thereby reducing the number of channels in the probe 100. Gas 106 existing the end of probe 100 may also aid in the remand of metallic vapor produced during the engraving process.

Laser systems with an output of approximately eight watts may be suitable for performing the engraving. If the concentrating reflector 102 has a diameter of four millimeters, for example, the area of the reflector 102 is approximately 12.56 $mm^2$ or approximately one-eighth $cm^2$. Thus, the energy concentration on the reflector is approximately 64 $watt/cm^2$.

If the 8-watt laser beam 72 is focused to a diameter of approximately between 0.025 mm to 0.05 mm at point 104, concentrations of approximately 1000 $watts/cm^2$ may be reached. In addition to engraving etching the bore of a barrel, the laser 72 may be used in manufacturing to rifle the barrel eliminating the step of machining or swedging the barrel. The laser formed rifling may itself be the barcode rather than a barcode on the lands of the rifling.

Figure 5:
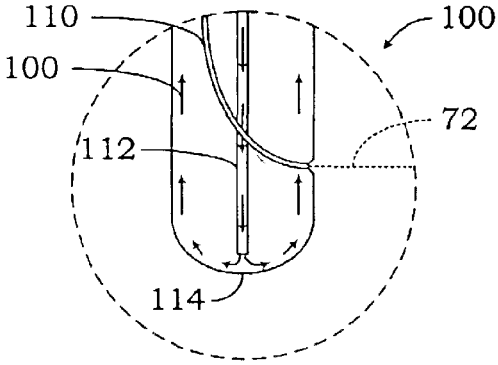
FIG. 5 is an enlarged view of a probe tip of the present invention.

Referring to FIG. 5, an optical fiber 110 may be used to direct laser beam 72 to the surface. A cooling tube 112 may extend to the end of probe 114 and release a gas or liquid 106 to cool the probe 114 and optical fiber 110.

Figure 6:
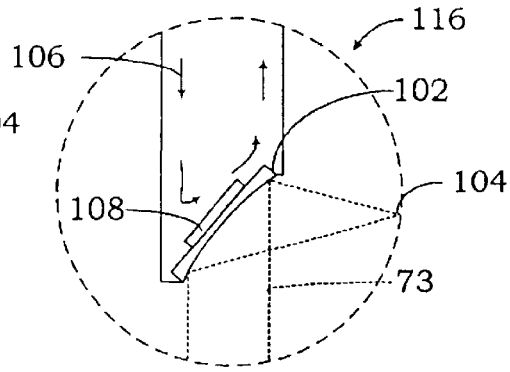
FIG. 6 is an enlarged view of a probe tip of the present invention.

Referring to FIG. 6, a reconfigured probe 116 is illustrated. The reflector 102 concentrates laser beam 73 external to the probe 116. This probe 116 configuration provides flexibility in manufacturing to allow an external laser separate from the engraver. Using this on the probes described herein above, the barrel may be moved while the probe remains stationary to etch the barrel breech of a weapon.

Figure 7:
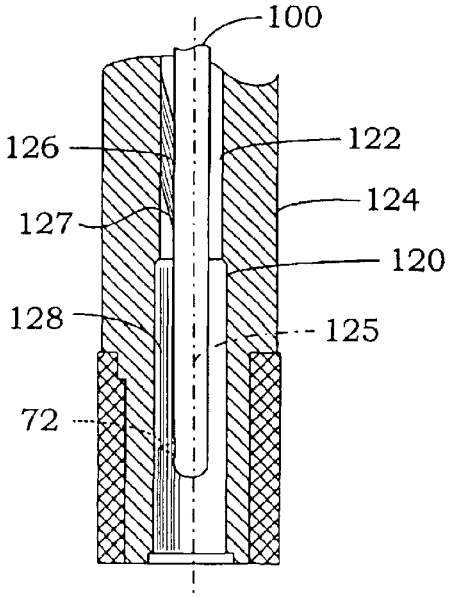
FIG. 7 is a sectional view of a probe etching the barrel and breech of a bore.

Referring to FIG. 7, a probe 100 is illustrated etching the breech 120 and barrel 122 of bore 124. Laser probe 100 is repeatedly moved back and forth or up and down (depending on the orientation of bore 124) along the longitudinal axis 125 of bore 124. Etched grooves 126 are formed in the barrel 122 of bore 124 by the laser 72 emitted from probe 100. Etched grooves 126 follow the rifling 127 of barrel 122. Etched grooves 128 are formed in the breech 120 of bore 124 by the laser 72 emitted from probe 100. Etched grooves 128 are generally parallel to the longitudinal axis 125 of bore 124. As the barrel 122 is etched, the probe 100 rotates to follow the spiral of the rifling in barrel 122. As the breech 120 is etched, the probe 100 does not rotate except at the bottom and top of the breech 120 with laser 72 off to reposition to the location of the next groove 128. The rifling 127 and grooves 126 and 128 are exaggerated for illustrative purposes.

Figure 8:
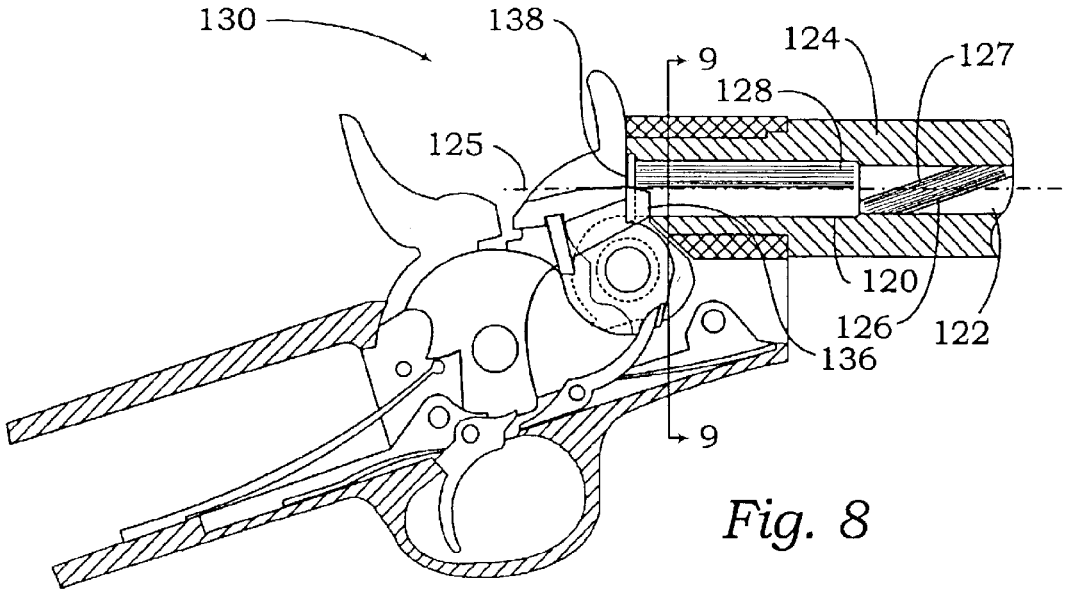
FIG. 8 is a partial sectional view of a rifle.
Figure 9:
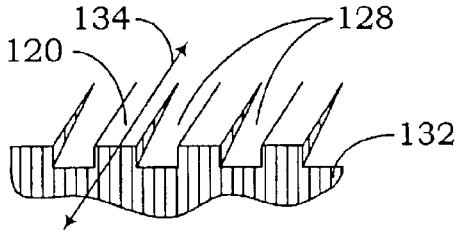
FIG. 9 is a sectional view of the breech of the rifle of FIG. 8.

Referring to FIGS. 7–9, the probe or engraver 100 is capable of engraving the entire length of a given bore 124 including the barrel 122 and breech 120 with markings 126 and 128 that may be transferred to the slug and casing for identification. The markings 128 in the breech 120 are formed generally parallel to the longitudinal axis 125 of the breech 120 and bore 124 and thus generally parallel to the loading and extraction vector 134 of a given loading and extracting mechanism 136. The markings 128 in the breech 120 extend from a starting point near the barrel 122 to the loading end 138 of the breech 120. Laser reflections may be analyzed by the computer through reflections returning into the optical system and being sent to a sensor by a prism or other method during the engraving process with either etching output and/or a lower poser setting of the main laser or a secondary laser separately, simultaneously, or alternatively, to monitor the engraving process.

in the breech 120 may gradually increase in depth toward the loading and extraction end 138 of breech 120 to further aid in reducing friction during extraction of a casing from breech 120. To further aid in ensuring proper extraction of a casing, the surfaces of the markings 128 may slope outwardly (not shown).

Markings formed non-parallel to the loading or extracting vector 134, or not extending to the loading end 138 of the breech surfaces 120 may cause the casing to bind in the breech 120. When the bullet is fired, the casing expands which transfers the markings 128 to the casing by pressing the casing into the grooves and thus forming raised elements on the casing. If these elements are not generally parallel to the extracting mechanism vector 134 which is generally parallel to the longitudinal axis 125 of the bore 124, the indentations in the casing may lock together with the grooves 128 in the breech 120 to lock the casing in place. If the casing binds in the breech 120, the extractor mechanism 136 may be unable to remove the casing causing the firearm to malfunction.

Referring to FIG. 8, the barrel 122 of bore 124 includes etched grooves 126 along and generally parallel to the rifling 127. The breech 120 of bore 124 includes etched grooves 128 generally parallel to the longitudinal axis 125 of bore 124. Grooves 126 and 128 are exaggerated in size for illustrative purposes. In practice, grooves 126 and 128 may be imperceptible to the human eye. Because grooves 126 and 128 may not be readily perceived, a user of a weapon which has been etched, may be unaware of the etching and thus not attempt to modify the breech 120 or barrel 122 to remove the etching.

Figure 10:
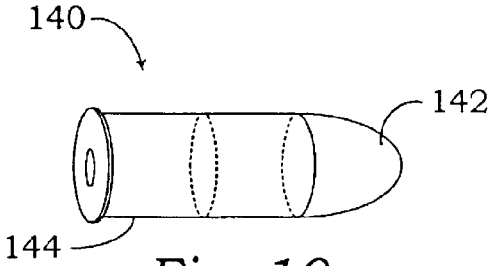
FIG. 10 is a perspective view of a bullet.
Figure 11:
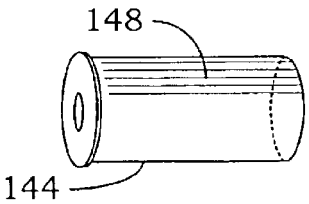
FIG. 11 is a perspective view of a marked casing.
Figure 12:
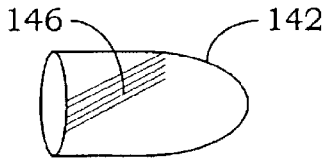
FIG. 12 is a perspective view of a marked slug.

Referring to FIGS. 10–12, a cartridge 140, a slug 142 and casing 144, is illustrated. Cartridge 140 includes a slug 142, sometimes referred to as the bullet or head, and a brass casing 144. When the cartridge 140 is fired from a bore 124 with grooves 126 etched along the rifling 127 of barrel 122 and grooves 128 etched in the breech 120, the grooves 126 are transferred from the rifling 127 to the slug 142 to form matching scratches 146. Additionally, the grooves 128 in the breech 120 are pressed into the casing 144 to form grooves 148 by the expansion of the casing 144 from the detonation of the bullet or cartridge 140. The grooves or scratches 146 and 148 transferred from the barrel 122 and breech 120 to slug 142 and casing 144 are the negative or reverse impression of grooves 126 and 128 respectively. Marking of both the slug 142 and the casing 144 with a bar code representing the registration number of the gun allows identification of the firing weapon from either the casing 144 or the slug 142. At a crime scene for example, sometimes the slug is not retrievable because it has been damaged or destroyed by the impact. Casings found that do not include a bar code or other identifying indicia cannot readily be traced to a weapon even if a suspect weapon is located. By etching the breech with identifying grooves, the casing can be used to identify the firing weapon.

Figure 13:
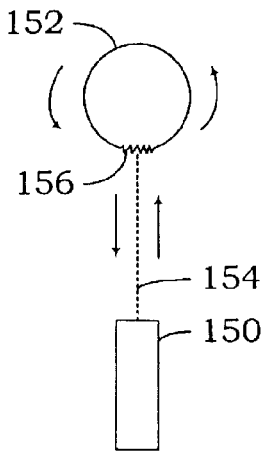
FIG. 13 is an illustration of a scanner configuration.

Referring to FIG. 13, a typographical scanner 150 builds a "map" of the surface of a bullet 152 by rotating the bullet 152 and scanning the surface with a fixed pulsed laser or light beam 154 in pulse increments smaller than the bar coding elements 156. The time each pulse takes to complete its path, from the scanner 150 emitter to the bullet 152 back to the scanner 150 detector is recorded and converted into a form to be used in retrieving firearm registration information.

Figure 14:
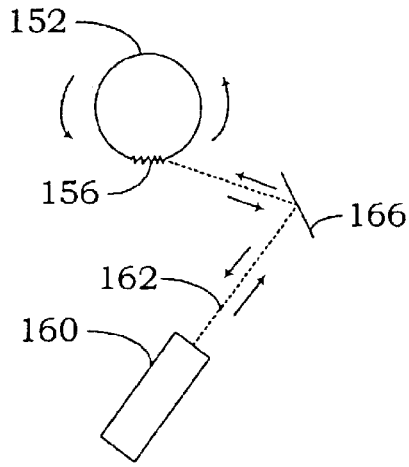
FIG. 14 is an illustration of another scanner configuration.

Referring to FIG. 14, a peak illumination scanner 160 directs a laser or light beam 162 over the surface of a bullet 152 at an angle which causes it to fall only on the high areas of the bar code 156, thereby illuminating the peaks of the bar code sequentially. The reflections are converted and used to access firearms registration information. The scanner 160 may be pointed tangentially to the surface of bullet 152 or other ammunition component such as the casing, using a mirror 166.

Figure 15:
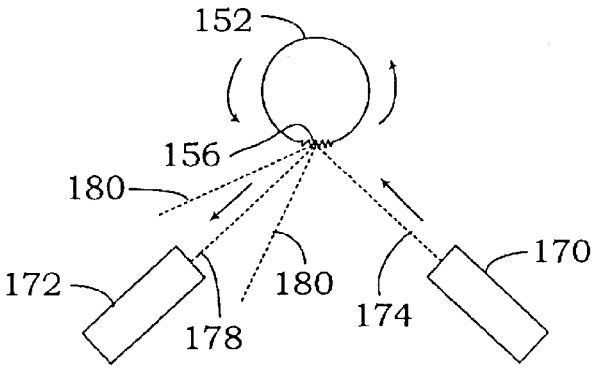
FIG. 15 is an illustration of a separate source and detector configuration.

Referring to FIG. 15, a beam scatter scanner 170 operates much the same way as the peak illumination scanner 160 except the optical detector 172 is placed so that when the laser beam illuminates a bar code peak 156 on a bullet's surface 152 at the correct angle 178, the reflection 180 is directed onto the detector 182. When the beam falls in a valley the angle of the reflection 184 will be different and not be directed onto the detector 182. Bullet rotation may also be the primary scanning motion using a fixed light source and detector. Rotation of the bullet or casing by a motor or other mechanism generally perpendicular to a scanning plane of the scanner may increase the likelihood of a successful scan. The scanner 170 may also be built so that the bullet 152 is stationary and the scanner 170 and detector 172 are spun by a motor, producing the effect of a beam moving over a surface. Also light from a light emitting diode may be focused onto a bullet instead of a laser and produce the same effect. The binary bit system is likely the most reliable choice of encoded data in this particular application because it may be less affected by physical distortion of the bar coded surface. The orientation of the scanner 170 and detector 172 may be rotated ninety degrees to scan in a vertical plane along the surface of bullet 152.

Using forty-eight bar code grooves on the breech and barrel of the bore of a gun is sufficient to provide over 100 trillion different codes. In the case of a barrel made with six rifling lands, one or two opposing lands may be used for placement of an initiator code which may be read by the system scanner to identify the scanned bullet as a bar coded bullet. The remaining four or five lands may then provide individual gun codes. A shotgun casing may also be marked in the breech for identification.

Figure 16:
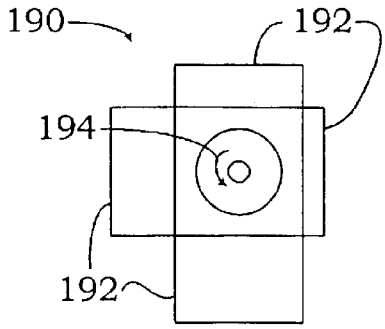
FIG. 16 is a top plan view of a multi-surface rotating reflector
Figure 17:
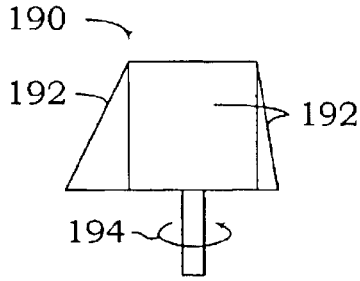
FIG. 17 is a side elevational view of the reflector of FIG. 16.

Referring to FIGS. 16 and 17, a multi-surface rotating reflector 190 having mirrors 192, each set at a slightly different angle to the axis of rotation 194 may be used in conjunction with any of the above-described scanners. The rotating reflector 190 produces reflected beams which move across different areas of a bullet's surface, making detecting a code more likely.

These scanners may also detect fluctuations of reflected light occurring in the same dimensions as the bar code to determine if bar coding exists, and if so, extract the bar code data.

Figure 18:
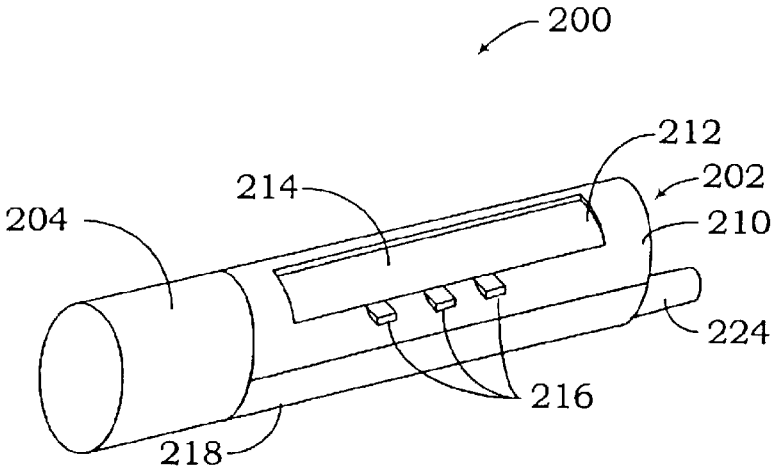
FIG. 18 is a perspective illustration of a mobile ammunition component scanner.
Figure 19:
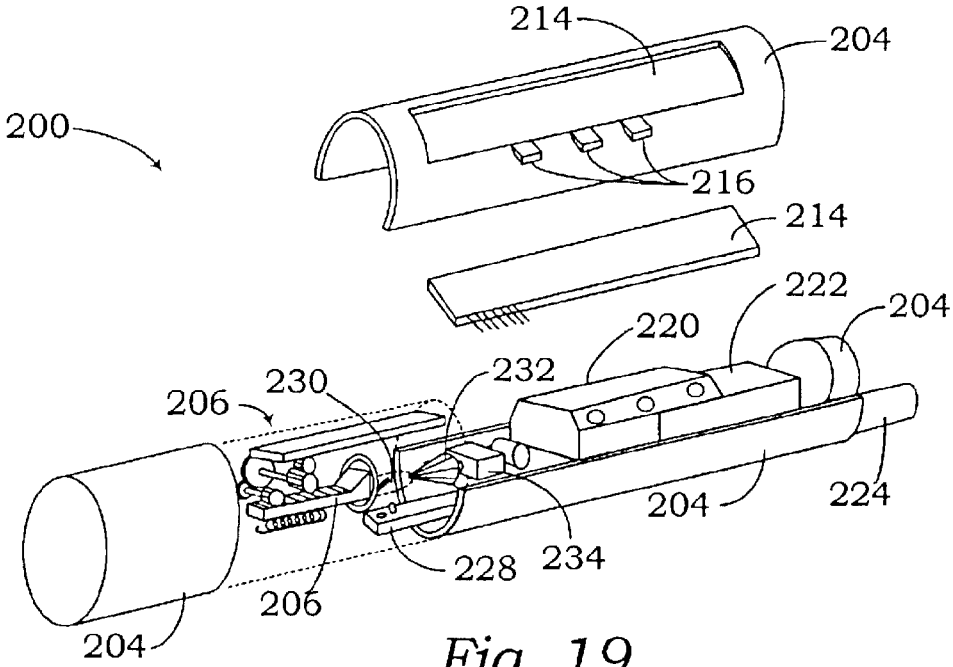
FIG. 19 is an exploded view of the scanner of FIG. 18.
Figure 20:
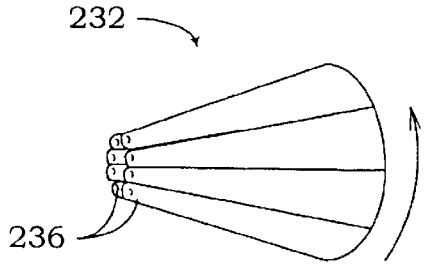
FIG. 20 is a perspective illustration of an ammunition component rotator tip.
Figure 21:
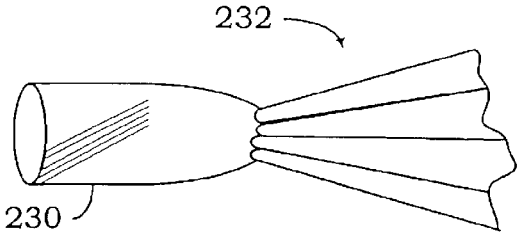
FIG. 21 is a perspective illustration of the rotator tip of FIG. 20 contacting a FIG. 22 is a perspective illustration of the rotator tip of FIG. 20 contacting a small caliber casing.
Figure 22:
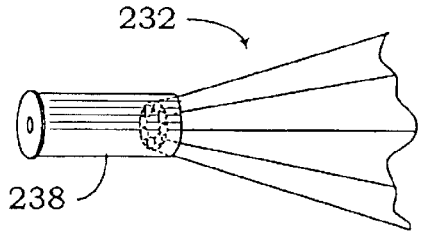
Figure 23:
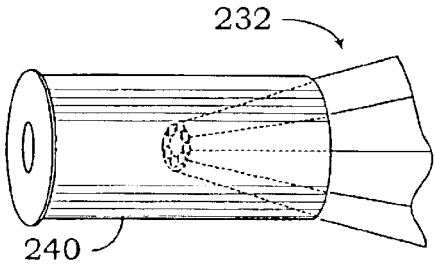
FIG. 23 is a perspective illustration of the rotator tip of FIG. 20 contacting a large caliber casing.

Referring to FIGS. 18 and 19, a mobile ammunition component scanner is generally indicated by reference numeral 200. Scanner 200 includes a case 202, which houses the scanner components. The scanner cover 204 translates between a closed and an open position. The scanner cover 204 is attached to the case 202 with a geared or lever mechanism 206 which allows for the positioning of the bullet holder 208.

Scanner case 202 includes a top cover 210 with an opening 212 for a liquid crystal display 214 and control buttons 216. The bottom portion 218 provides a mounting for the components of scanner 200, which includes a central control and display driver microprocessor 220, a GPS receiver and wireless communication link circuitry 222, a dual (or separate) GPS/wireless antenna 224 and a rechargeable battery 226. A scanner 228 is directed toward a bullet 230 which is held in place by a replaceable universal ammunition component rotator tip 232 extending from a motorized reduction gear 234. The detector/illuminator assembly 228 may include a stop or roller that contacts an ammunition component 230 during scanning operation to maintain the detector at an acceptable distance from the ammunition component 230. An auto focus may also be used to assist in scanning the ammunition component. Based on the distance of the scanner 228 from the centerline of the rotator 232, the caliber of the ammunition component 232 may be determined. A printer (not shown) may be attached to the mobile scanner 200 to print police reports using the collected data to reduce or eliminate the need for hand written reports.

Referring to FIGS. 20–24, the universal ammunition component rotator tip 232 includes a plurality of fingers 236 made of a rubber or other pliable material. The fingers 236 of rotator tip 232 readily conform to the tip of a bullet 230, a small 238 or large 240 casing, or a damaged or deformed bullet 242 to allow the ammunition component to be rotated and scanned. The diameter of the end of rotator tip 232 may be approximately 0.2 inches.

Figure 25:
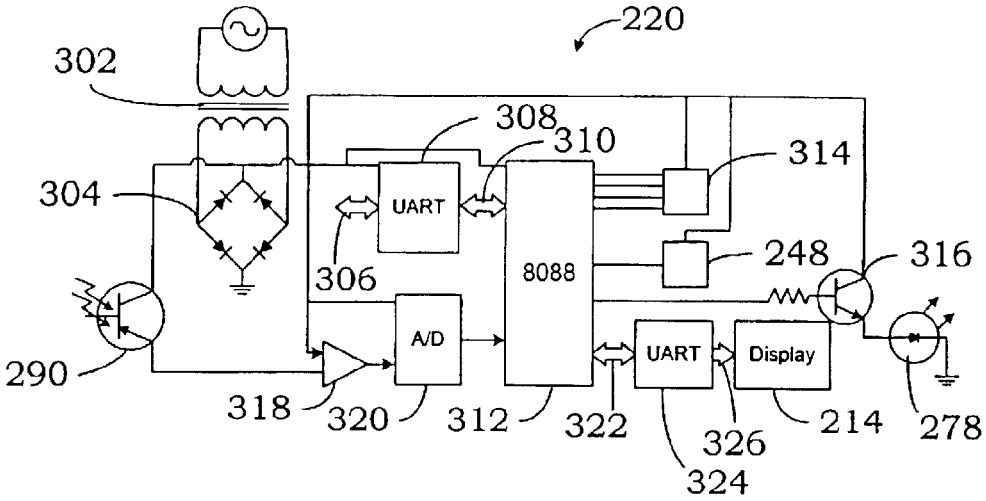
FIG. 25 is a schematic of the scanner circuit.
Figure 26:
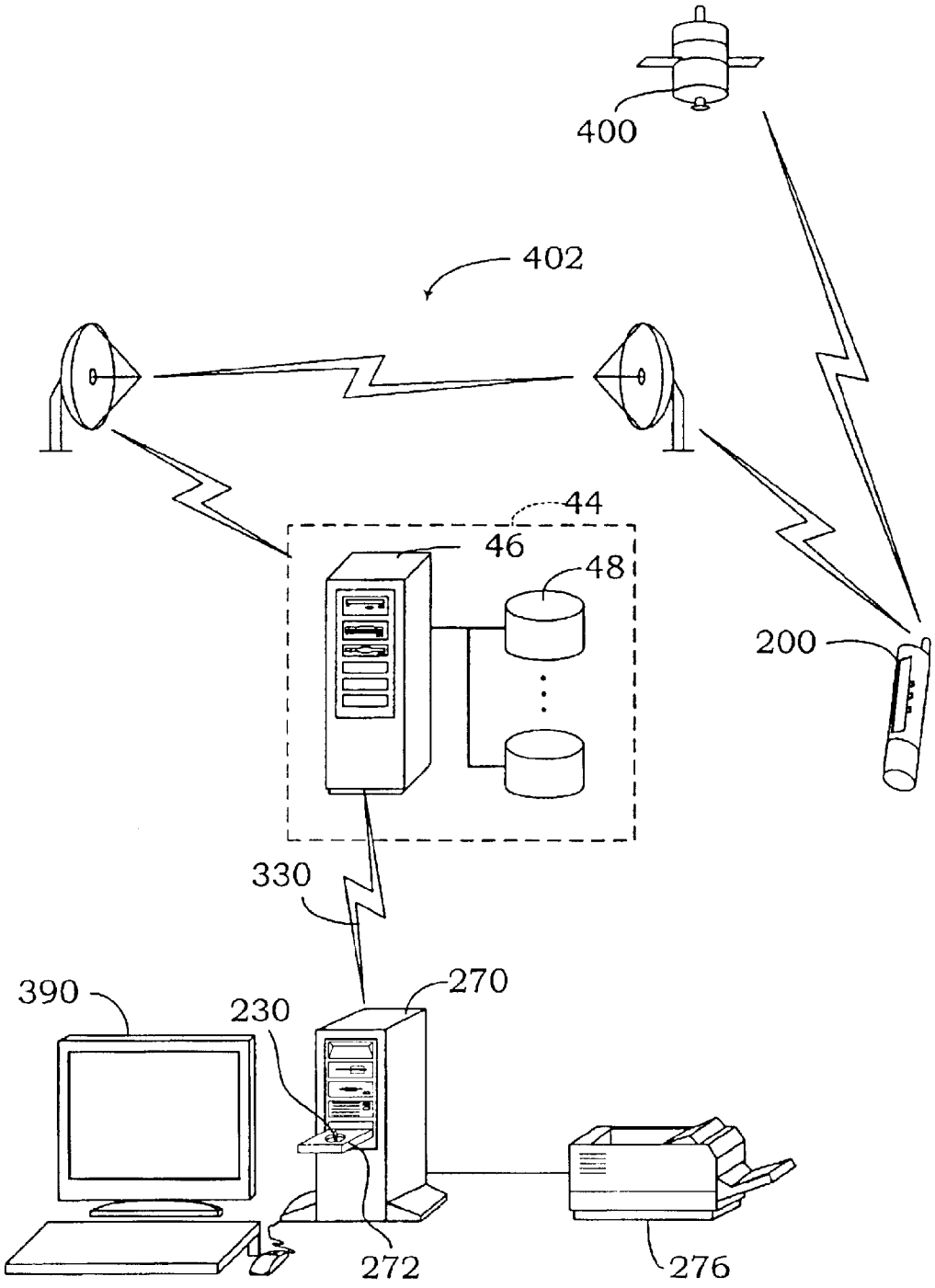
FIG. 26 is a diagrammatic illustration of the barcode bullet scanning system for scanning and identifying a marked bullet.

The scanner circuit 220 as shown in FIG. 25 may be used in both the portable scanner 200 and the desktop scanner. The scanner circuit 220 includes transformer 302 and full wave rectifier 304 which provides 5 volts DC for circuit 220. UART 308 provides an interface between 8088 microprocessor 312, and computer 70 over lines 306 and 310. Microprocessor 312 controls scanner bed 272 stepper motor 234. Upon command from control buttons 216 on the front of scanner 200 or from computer 270, microprocessor 312 activates transistor 316 to enable laser diode 278. Bullet 230 is rotated in scanner bed 274 so that the entire width of the barcode may be scanned. Light reflected from a barcode on bullet or casing 230 is received by phototransistor 290. The signal from phototransistor 290 is input to amplifier 318 and fed through A/D converter 320 and stored in RAM 382. Microprocessor 312 converts the encoded signal into digits 384, by a method known in the art. If valid data is not detected 386, bullet 230 is scanned again. Scanning may be attempted two or more times before scanning is abandoned and an error message displayed.

If valid data is detected, the data is output on line 322 to UART 324 and transferred on line 326 to display 214 on the front panel of scanner 200. The digits are also transferred via UART 308 over line 306 to computer 270, which are assembled into a serial number. The serial number may now be transmitted over communication link 330 to law enforcement computer system 44, which includes computer 46 and databases 48 and the file corresponding to the data is requested. The serial number is matched with data in databases 48 and the associated registration information is transmitted back to computer 270 and displayed 390. This information may then be printed on laser printer 276. Accordingly, the bullet may be traced to the firing gun and the registered owner of the gun.

Figure 24:
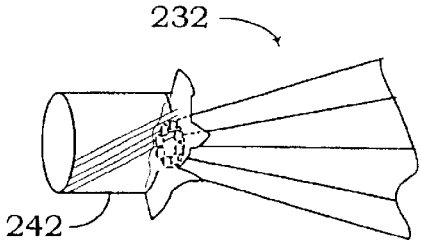
FIG. 24 is a perspective illustration of the rotator tip of FIG. 20 contacting a damaged slug.

Referring to FIGS. 24 and 25, to read barcode 260 on bullet 258, bullet 258 is placed in scan bed 274 in barcode bullet scanner 272, which is linked to computer 270. Microprocessor 312 activates the scanner and detector current 380. Laser diode 278 outputs a 5 milliwatt laser 280, which is reflected from mirror assembly 282 rotated by motor 284 through beam focusing lens 286 and reflected from bullet 258 through light condensing lens 288 onto phototransistor 290. The diameter of the beam incident on bullet 258 should be at least one half the spacing of the individual bars of barcode 260, which may be approximately 20 to 50 microns. 100 microns may be the upper limit of spacing or width of the grooves, due to the amount of data and the available area on the rifling lands.

Figure 27:
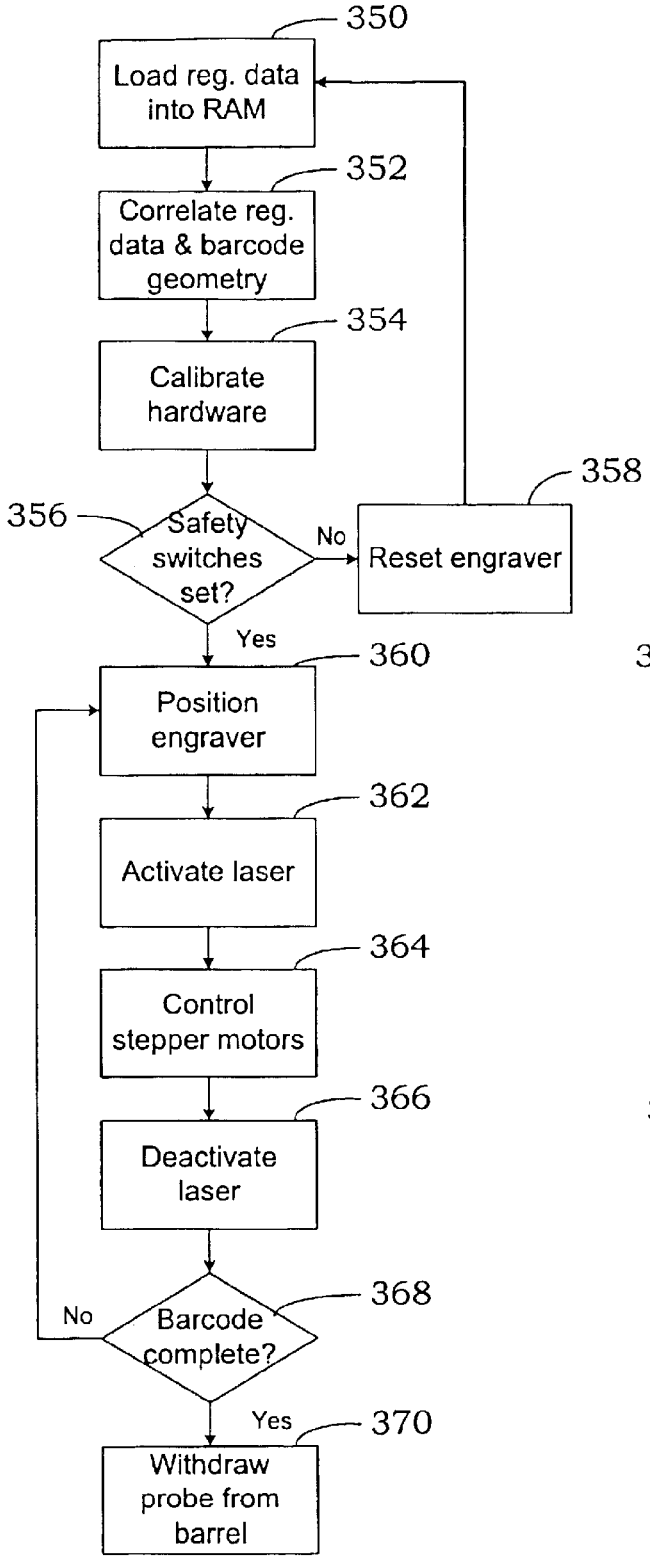
FIG. 27 is a functional block diagram of the engraver control software.

Referring to FIGS. 1,2 and 27, the model number, make and serial number of rifle 32 is entered into computer 38 and this data is transferred to controller 24. The registration data is stored in RAM, block 350. The microprocessor reads the gun parameters from memory and correlates the registration data and the barcode geometry, block 352. After the hardware is calibrated, block 354, safety switches are checked, block 356 to ensure that the cabinet 22 door is closed for example. If the cabinet 22 door is not closed the engraver is reset, block 358, and processing returns to the start.

If the safety switches are set, block 356, the engraver is moved into position, block 360. Vertical positioner worm gear 76 powered by stepper motor 78 moves laser control tube assembly 52 into the start position under supervision of the microprocessor until closure of switch 84. Additionally, laser tube 62 is rotated by stepper motor 88 again under supervision of microprocessor 160 until closure of switch 90. Etching probe 30 is now in place in the bore.

The microprocessor retrieves data concerning firearm configuration, if necessary and specific barcode instructions from memory or from PC 38. Once laser etching probe 30 is in position, the microprocessor activate the laser, block 362, commands a coolant pump (not shown) to begin circulating coolant through passages 64 in order to maintain stability of laser reflector 70 while in contact with the laser beam 72.

After laser tube 26 has reached operational temperatures, a carbon dioxide laser is output from laser tube 26 into fiber optic line 28, which is injected into laser tube 66, reflected from laser reflector 70 and transmitted as beam 72 into the bore of rifle 32. Laser tube 26 is switched on and off while laser etching probe 100 (FIGS. 3–5) is rotated lowered rotated again in the opposite direction and raised continuously forming grooved bar coding dyes in the bore of rifle 32. The laser is activated, block 362 and the microprocessor controls the stepper motors, block 364 to form a grooves in the bore of rifle 32. At the end of each groove or barcode strip the laser is deactivated, block 366 and the microprocessor checks to determine if the barcode is complete, block 368. If the barcode is not complete, the engraver is positioned, block 360 to the beginning of the next stripe and the process repeats.

The grooves of a barcode may be from 10 to 50 microns in depth. The serial number of a rifle is encoded into the space and bars of various widths of barcodes. The number of characters represented in a linear inch of a barcode is called the barcode density, which depends on the barcode symbology. For example, using Code 39, 9.4 characters can fit in one inch. The resolution of a barcode is dependent on the narrowest element of a barcode. Because of the relatively small circumferential area available in bore 254, barcode 256 is compressed or scanned from the standard barcodes known in the art. For example, interleaved 2 of 5 which is capable of encoding up to 30 digits may be scaled from 17.8 characters per inch to 17.8 characters per 0.125 inches or 142.2 characters per inch. Other codes could be used such as Code 128 which can encode the entire 128 ASCII character set.

Additionally, a barcode may consist of a number of bars followed by a space sufficient to distinguish groups of bars. In this way, the bars need only be counted followed by a space to distinguish digit placement.

By way of example, a 38-caliber head gun has a bore circumference of approximately 1.2 inches. Using an 800 steps/revolution stepper motor, the angular distance is 0.45 degrees/step or approximately 0.0015 inches/step. For a barcode 0.125 inch wide and using interleaved 2 of 5 scaled by eight, 17 characters can be encoded. There are approximately 83 steps in 0.125 inch. Using a stepper motor with an angular resolution of 3200 step/revolution, 71 characters can be encoded a 0.125 inch barcode using interleaved 2 of 5 with a step spacing of 0.000375 inch.

Once the barcode is completed, block 368, the etching probe 100 is withdrawn from the bore of rifle 32. Information regarding the serial number, make and model of rifle 32 may now be transferred from computer 38 to law enforcement system 44 over communication link 42 to be stored in databases 48 connected to computer 46. It should be understood that data from more than one gun may be transmitted together to computer system 44.

The scanner program converts the bar code into data and retrieves firearm registration information. The decoding software can also be made compatible with and adaptable to function in tandem with an existing computerized photo comparison type identification system, to detect and decode barcoding through digital video signal analysis.

The desk top computer/scanner software includes predation pattern analysis algorithms for geographic targeting. A detective or police officer at a crime scene may collect physical evidence such as a casing or slug including its geographic coordinates using GPS data from global positioning satellites and enter other crime scene data via push button or voice control on board the portable scanner. A user may enter information based on intuition or suspicions into the software which calculates the applicability of the data and incorporates the data based on these calculations. Sites may be deleted or tagged during a search by officers with the mobile scanner input or police computer to allow for the automatic updating of a file and search.

The global positioning satellites may provide precise geographical information relating to the crime scene to the processor which sends this geographical information along with information obtained by scanning the bar code on the ammunition components. The data from a scanned casing or slug may be transmitted over a cellular telephone network to the local police department computer or to a national database. The law enforcement computer may use all or part of the data sent by the portable scanner including altitude, GPS coordinates, last known owner of the weapon firing the bullet, any illegal history of the weapon, and possibly other relevant data to construct a model similar to a topographical or relief map, for example. Identification data based on the scanned casing or slug data may be transmitted back to the portable scanner for display.

The collection and analysis software may be completely automated constructing the geographical profile on a real-time basis. The analysis may be updated and adjusted as additional data is received. The analysis software may include basic geographic targeting algorithms used in other criminology analysis software based on Brantinghams' crime-pattern theory and Rossmo's least effort principle, and incorporate other information gained by scanning the bar coded bullets such as the address of the last known owner, if the gun was reported stolen (when and where), or if the gun has been used in another location to commit another crime, and the three-dimensional GPS data.

A geographic profile of the weapon use is developed to narrow the search for a suspect in a crime. If a criminal is already in custody, a search for evidence, such as a murder weapon for example, may be developed from the criminal's geographic profile to narrow the search area.

The collection and analysis may operate in real-time to provide timely information to a police officer or detective. Analysis may include such information as the psychological profile of the last owner.

Figure 28:
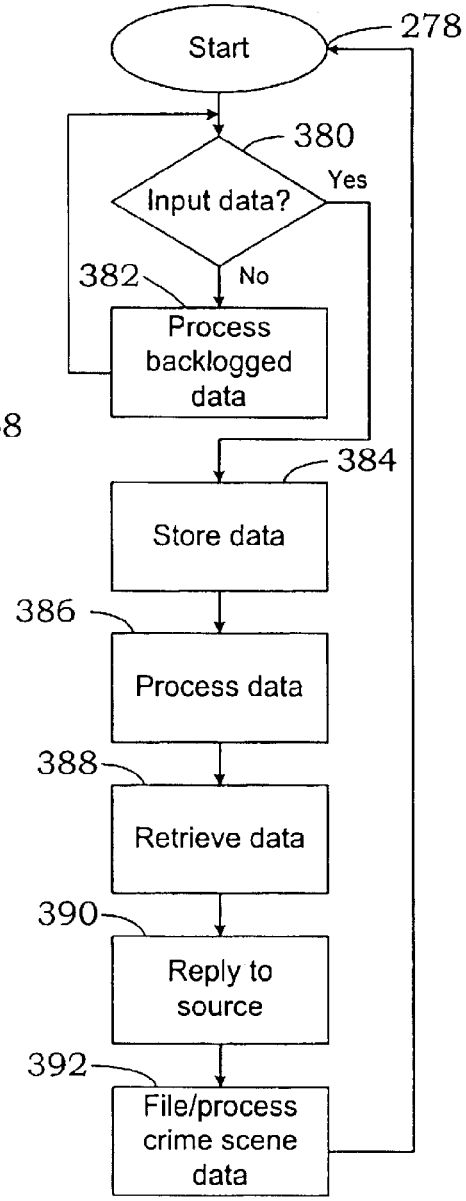
FIG. 28 is a functional block diagram of the scanner control software.
Figure 29:
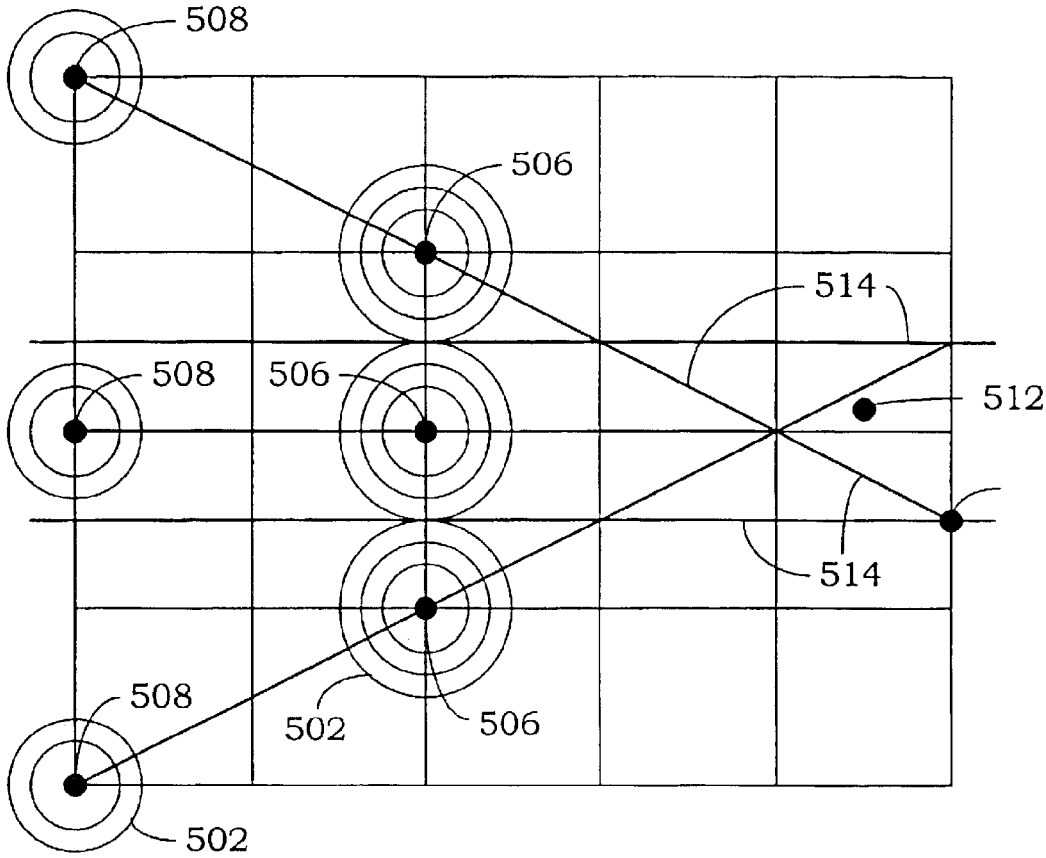
FIGS. 29–34 are diagrammatic illustrations of two-dimensional probability maps.
Figure 30:
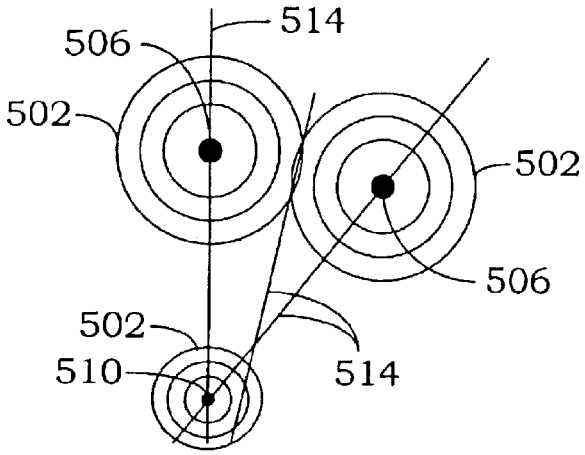
Figure 31:
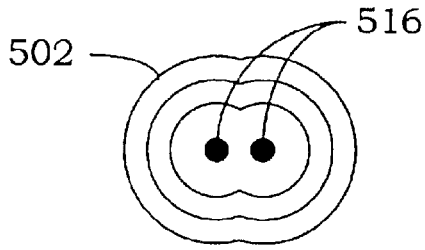

Referring to FIG. 28, desktop computer/scanner software begins at block 378. The system waits for input. If no input is present, decision block 380, the system processes backlogged data, block 382. If data is present, the data is stored, block 384, and processed, block 386. Matching data is retrieved from the central database, block 388, and sent to the requesting source such as the desktop computer or the mobile scanner, block 390. Once scanning is complete, the data is stored and the crime scene data is processed, block 392.

Various types of data profiles and models may be constructed and used through application of mobile scanner and officer supplied data. At least three different geographic points may be available from a single shooting or gun related crime scene. For example, the crime scene location may be provided by the automatic GPS system on the mobile scanner or through computer keyboard at the police lab. The location of last known gun owner's given address. In the case that a gun has been reported stolen and there exists a suspect in the theft, the estimated location of a suspect can be used instead of or combined with owner or purchaser location data This may be viewed as an additional codependent data point. The suspect may also be wanted by a law enforcement agency for other crimes, the locations of which can be integrated into profile. A third location is the point of purchase (PoP) for the given gun, elapsed time of purchase to use and directional relationships of PoP. Owner/suspect locations and crime scenes may also be taken into account.

Referring to FIGS. 29–32, a geographical profile can be created from locational and directional data associated with these points. "Geo-file" data may be displayed using a number of formats. A relief-map-like display shows the probabilities that a suspect is located at each map point by raising a line from each point on the map, the height of which is representative of this probability through a series of color-coded elevations.

Figure 32:
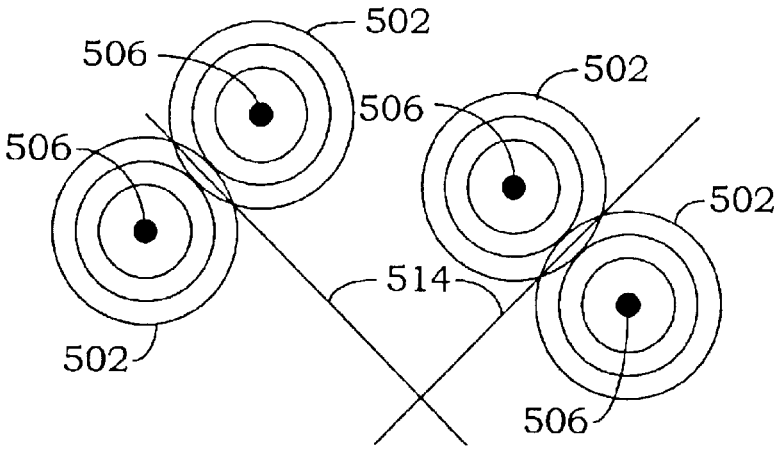

A two-dimensional map 500 shows the same data as a relief map, without the application of the third dimension to the data, placing graded color codes or concentric circles 502 overlaid on a map. Data that may be shown on map 500 includes a grid 504, crime scene locations 506, dump sites 508, PoP data 510, bar code data 512 and relational vectors 514. When two or more crime scenes are close geographically, the points may be combined into a single crime scene location for analysis, 516. The enclosed or intersecting area bound by the concentric circles 502 around a crime scene 506 with relational vectors 514 and point of purchase data 510, may present a bounded search area for a suspect. Similarly, if only crime scene locations 506 are known, a search area may be developed from intersecting relational vectors 514 (FIG. 32). The point from which the shot was fired may also be determined using listening devices place throughout a neighborhood or city. Using triangulation, the point from which the shot was fired may be determined along with the time of the firing.

A numerical value map may show the same data, but instead of converting map-point number values to color coding, the actual numerical value itself may be displayed. A built in "zoom" function may be useful in all display modes, and especially so with the numerical value map, being able to conglomerate and average data for far distance viewing, and also to do as much detail resolving as is practical and desirable as the operator selects differing viewing distances.

"Time to crime" type statistical modeling may indicate several related aspects of interest to law enforcement agencies and legislators. The time and date of gun purchase, the amount of time elapsed until the gun was used in a crime, the precise time/date ammunition component(s) was scanned, and time/date of crime(s) as estimated by a detective or police lab. This data may be used to determine if guns are purchased or stolen from any particular retailers being used in crimes more often or sooner than other retailers. Additionally, time to crime data may be used to determine if guns are being used by or originating from owner/purchaser(s) who tend to reside in or work in certain areas or districts more often or rapidly than other areas or districts.

Police officer patrols can be computer designed and directed so that officers are more likely to be closer to areas more likely to experience criminal activity(s), and also to have officer patrol routes more often over-lapping into suspect search area(s).

The software may produce displays of automatic or selected crime related values that can be adjusted and varied automatically or manually, to identify possible relationships between crimes that may have not been noticed otherwise, and notify user(s) if correlation is observed. In a desperation search the computer may adjust or vary all or some variable values, through all or part of given envelope(s), to produce variations of profiles and models for a particular ongoing investigation, making special note of and notifying user(s) of profile and model versions that produce especially odd, defined, or conclusive results.

The geographical profiling process may employ other factors, through access to other computers equipped with other types of software including geographical profiling (Rigel, Dragnet, or Crimestat) programs, or other type services such as psychological profiling, and integration of imported data analysis results.

The program may also integrate data input(s) from mobile ammunition component scanner subsystems, desktop scanner, or other devices such as properly equipped computers, into its profiles and models. Aspects of Bantingham crime pattern theory may be applied in this respect. Many variables may relate to a computerized investigation such as:

Descriptive crime scene data has a role in geo-profiling process. If a suspect/owner is employed and where may be optionally applied. Additional crime scene descriptive values may be compounded and compared, normally raising the values of descriptive details of crime scene (D), the mental state of suspect (I) and the extra force used (F).

Extra force used on victims during or after an initial or motivating crime can relate to the mental state of the offender. Business districts, office buildings, or other areas that are non-residential in nature can automatically or selectively be removed or otherwise accounted for. If multiple crime scenes descriptive data and or proximity data are sufficiently similar they may be considered as a single site. If bar code data shows gun owner to reside within a given perimeters of other scene(s) locations, then probability of gun owners direct involvement in crime(s) increases with decreasing distance from crime scene(s). In cases of multiple crime scenes Suspect Safety circles overlap or come relatively close together, these points of contact may also be considered as relevant geographic data.

The intersections of extensions of the longitudinal axis of the over-lapped areas also are valuable data points. If the gun owner/suspect originates from a more distant location, map-points corresponding to local lodging facilities (motels etc.) would be considered more likely to be productive search targets. Distances generally should be given in metric form and can be measured as straight lines in space or as estimated distance traveled by use of surface routes and pavements, by suspect. PoP data can supply additional leads in the form of contactees and video security records kept by retailer.

If a person is shot during a crime, to obtain assets or property considered to be of little relative value, it may be assumed that the shooter does not reside in an upper-class area, and may most likely be from a lower-class area or district.

If a motor-vehicle is involved, the desktop software can access DMV (Department of Motor Vehicles) data-bases, and use vehicular data including color, make and model, license plate number etc., to locate registered owner/s of specific types or exact vehicles, for immediate police use, and profiling and modeling routines.

Witness statement data analysis through data from multiple witnesses on same subject being compared to each-other, and being displayed with the most common statements being more likely correct, and conflicting or less often made statements being less likely to be correct.

In all display modes, if specific gun related data is present, corresponding, flashing or active or non-active icons or unique indicator/s, may be placed in relation to location on display or otherwise. Regional sections or districts can also provide historical data of criminal concentrations and crimes relating to activity in and out of the sections/districts to attenuate the program for use in specific areas, as different cities, counties or states may have different activity types, associations and requirements.

The following equations may be used to determine the mental state of a suspect I and then for any point the relative probability of locating the suspect at this location R.

$$I = \frac{D + F + U + T}{\frac{A}{B} - (Q - M) + \frac{A + K}{C + K} + \left(\frac{AB^2}{O - P}\right) + JGT} \qquad \text{Equation 1}$$

$$R = \frac{J \Big/ \left(\frac{(C + K/(A + K)}{(Ba + Ca)/(Aa + Ca)} + \left(\frac{I - E}{(A/O) + (C/O)}\right) + \left(\frac{I^{-1}}{L - O} + (E/D)\right)\frac{P(Q + F)}{Aa + Ca}\right.}{\left(\frac{I}{AB/O} + \left(\frac{I}{AaBa} + \left(\frac{(A/Aa)}{(L/Da)} + \frac{1^{+T}}{(K/Ca)_{+Q}}\right)\right)\right) + \left(\left(\frac{ACKL}{AaBaCaDa}\right) + \frac{(I_{-H}^{E}) + G}{A + B(EF - T)} - (E + N) + (M/Q)D\right.} \qquad \text{Equation 2}$$

Where the variables applied in these equations for profiling/modeling process(s) are as follows:

A is the mean distance from map-point to crime scene(s);

Aa is the mean distance from the gun owner's last know address to the crime scene(s);

Ab is the mean distance from a suspect location(s) to the crime scene(s);

B is the mean distance from map-point to location of last known owner's given address;

Ba is the mean distance from owner's last known address to point of purchase;

Bb is the mean distance from a suspect location(s) to evidence location(s);

C is the mean distance from map-point to the point of purchase;

Ca is the mean distance from owner's last known address to evidence locations;

Cb is the mean distance from a suspect location(s) to equidistant point from longitudinal axis extension intersections;

D is descriptive details of crime scene(s), positive effect;

Da is the mean distance from owner's last known address to point used to determine the value of variable O;

E is the elapsed time between firearm purchase and use in crime(s), positive decreasing to negative;

F is extra force used, positive effect;

G is whether the gun was stolen, positive effect;

H is the time elapsed since gun theft, positive decreasing to negative effect;

I is the mental state of suspect, indicates initiative, willingness to accept risk to safety, see Equation 1 above;

J is economic considerations, positive or negative effect depending on relationship;

K is the mean distance from map-point to dump-site or evidence location(s);

M is the time and date of crime to the closest possible minute;

N is the time between crimes, decreasing positive to increasing negative effect;

O is the mean distance from map-point to data point perimeters overlapped areas longitudinal axis(s) extension intersections most equally distant map-point;

P is the nature of map-point, residential, industrial, business, parking lot, hospital, school, government office, lodging or camping, recreational, highway rest-stop, airport, etc., positive or negative effect depending on relationship;

Q is the time of day, since businesses and other facilities are opened and closed at regular times, positive or negative effect depending on relationship;

R is the relative probability residence of suspect is at this map-point, see Equation 2 above;

S is the mean distance from map-point to location of gun theft suspect location(s), which may be relatively general in practice;

T is whether the last known owner previously wanted by the law, positive effect if yes;

U is whether the gun theft suspect was previously wanted by the law, positive effect if yes;

The latter two values may relate to nature of previous offense(s), the location of previous offenses can also be added to geo-file. Based on these locations and relative probabilities, concentric, color coded rings can be made around significant data locations such as crime scene locations. Areas can also be color coded. Coloring may be respective to risk to suspect and initiative ratio(s). The indicated values could start high with varying hues of red, decrease with varying hues of orange, yellow, and green respectively, and end low with varying hues of blue.

The programs profiling and modeling subroutines may be applied retroactively, in real-time, or an operator may test hypothetical future scenarios in a selected area, to determine if a given type crime were to occur in a given area, where would a suspect(s) reside or originate from. These "future tests" may help to tailor a users program for use in a specified are, and to prepare for events more thoroughly.

The system may be used to automatically notify other properly equipped police labs and officers of crimes being committed within specifiable radius(s) of police stations, patrolling officers or other selected site(s), for instance schools, government offices and so on. This feature could prove most effectively applied to cases involving serial killers or terrorists who may affect increasingly larger areas.

An open-source platform may be preferred for desktop scanner/computer software, in that open-source software would provide for more rapid widespread use, owing to relative ease of availability, the cost free nature, and modifiability of open-source software.

Figure 33:
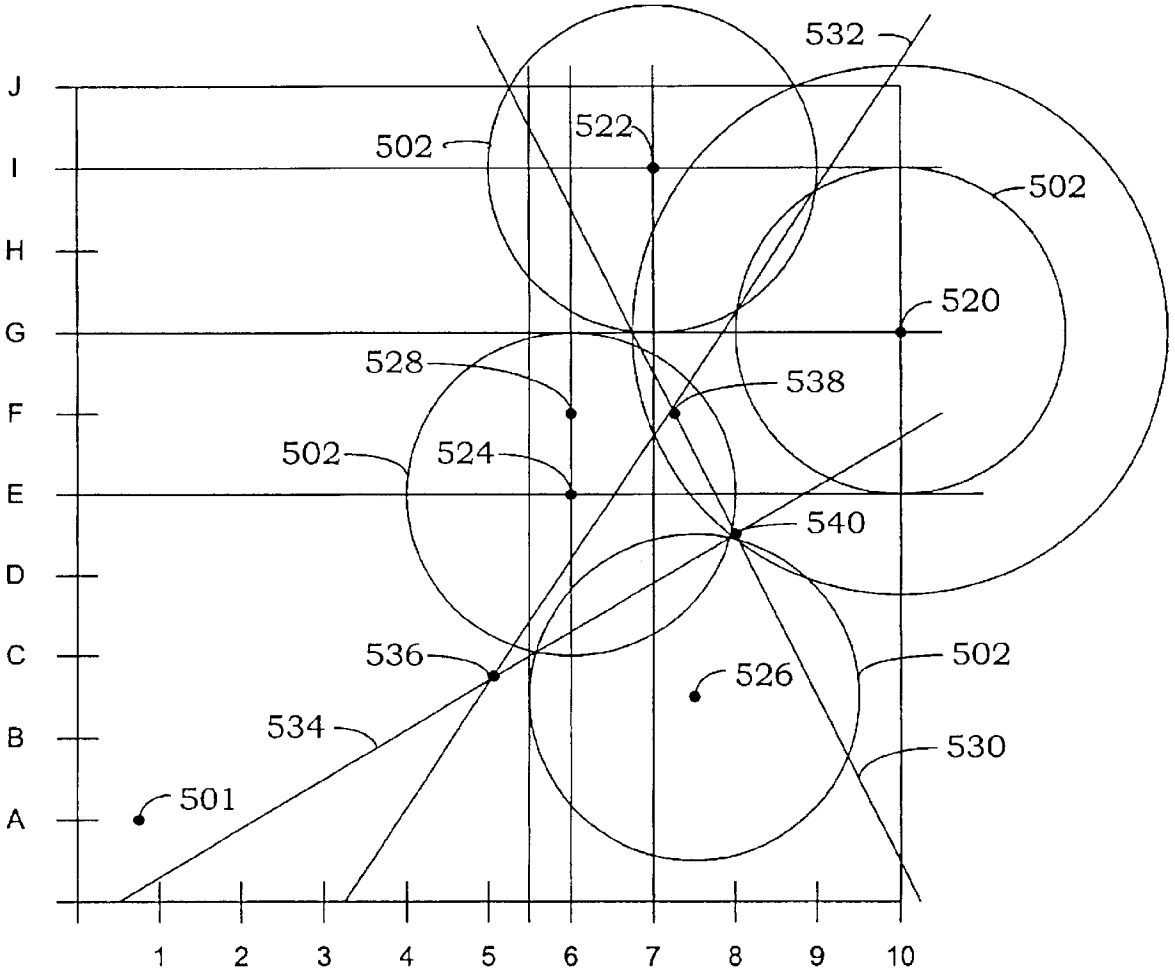
Figure 34:
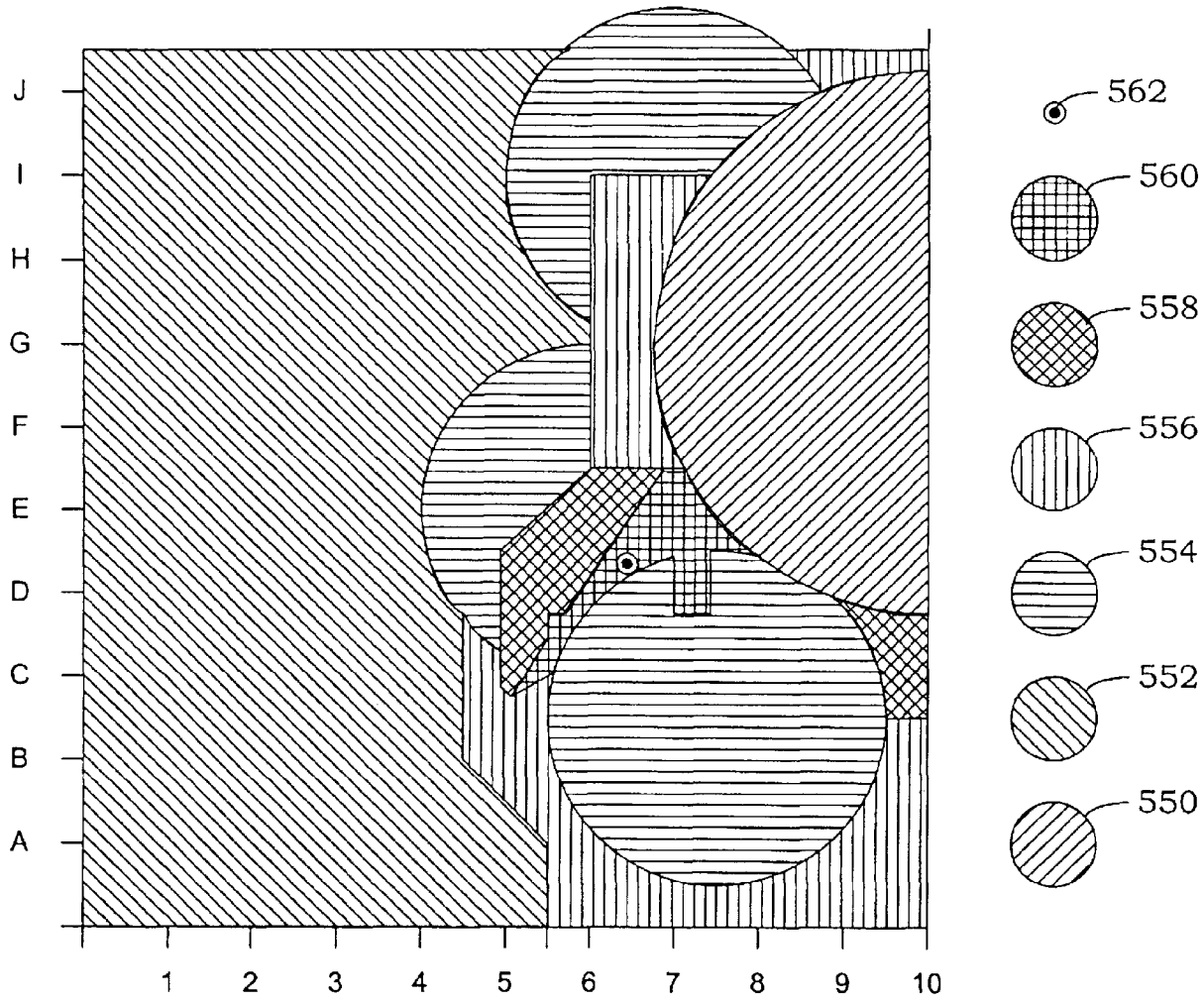

Referring to FIGS. 33 and 34, an example of probabilities based on the formulas above is illustrated. The area of the example is twenty square kilometers and is divided into four quadrants. The area centered around point H,3 is industrial in nature. The area center around point C,3 is upper class residential in nature. The area centered around point C,8 is lower social economic class residential in nature. The area centered around point H,8 is commercial in nature. The class/income of the residential areas change linearly between points A,10 (total poverty) and E,1 (exclusive executive).

Suppose a gas station attendant has been shot multiple times but survives. The intent to commit the crime is clear. A total of $32 was stolen by the criminal, which indicates economic disparity. An ammunition component found by a police officer who uses a portable scanner to detect and decode a bar code. The data is transmitted to a police computer connected to the central database, which retrieves specific information related to the firearm involved in the crime. Suppose that the information indicates that the gun was reported stolen, the registered owner has no criminal history or is not currently wanted, the owner is employed and not experiencing any financial difficulties and the registered owner was at his place of employment at the time of the crime as verified by his employer. Thus, no suspect may be identified at this time. The firearm is recovered the next day, no finger prints are found.

Based on this information, the GPS coordinates of five points are now available. Point 520 is the location of a crime scene (coordinate G,10), the location of a bar coded shell casing or bullet is point 522 (coordinate I,7), the address of the last known owner of the firearm matched to the casing or bullet is point 524 (coordinate E,6), point 526 is the location of a recovered firearm (coordinate B.5,7.5) and point 528 is the place of purchase (coordinate F,6). Other significant points and areas may also be determined. Axis extension intersections of lines or relational vectors 530, 532 and 534 based on the intersections of concentric circles 502 present intersection points 536, 538 and 540.

These points are used to calculate distances between points and determine other points which produce the greatest number of quotients closest to the number one which would be displayed as a map point which is more likely to produce values that are displayed proportionally to their numerical range. For example, if the distance quotient from the crime scene 520 to the registered owner's address 524 is one, and the distance quotient from the location of the coded casing or bullet 522 to the registered owner's address 524 is also one, then a crime was likely committed at the owner's address. The person who committed the crime may not be at the crime scene, may be the victim or is not readily available. In cases which necessitate investigation to locate a suspect, the apparent mental and emotional state of mind of the suspect, descriptive crime scene data and chronological relationships may be analyzed, distributed and displayed.

Because the gun was stolen the point of purchase is essentially irrelevant for this example and the owner is ruled out as a suspect. The crime scene descriptive data is used to estimate a perimeter, inside of which the proximity to the crime scene produces increasing risk to and less likely location of the suspect as the distance from the crime scene decreases 502. In the case where excessive force was used, the perimeter increases (circles 502 around crime scene 520).

The value of D may be compounded based on the crime scene related aspect ratings including, the type of crime(s), the number of victims and the amount of force used. In this example the crime scene is that of an armed robbery and attempted murder. On a point scale of one to ten, an armed robbery ay receive five points (Dx=5), a murder or attempted murder may receive nine, ten or more points (Dxx=9) depending on the force used. These variables are added together and multiplied by the number of victims. In the present example, the victim was shot three times in the chest, each of which could have proven fatal if medical attention had not been administered. Each shot may be considered separate attempts to inflict a fatal injury with an equal amount of force. So the violence used (3) is divided by the effort required (1) to determine the force F=3. The number of victims is 1 (Dv=1). Thus to determine D,D=(Dx+Dxx+F) Dv or (5+9+3)×1, which equals 17.

The crime scene data, gun specific information, distances involved, economic considerations and time may be used to determine the value of variable I. Variable I is a general indication of the suspect's emotional state. Increasing distance and time may benefit the criminal. Variable B may be omitted in this example since the registered owner of the gun is not a suspect. The map point in this example is point 501 (coordinate A,1) which falls in an exclusive upper class community.

Variable I may be determined by compounding the descriptive crime scene data with other risk factors to the suspect, such as the use of a stolen gun, stealing the gun and other property and other arrest warrants that may exist. In this example, the gun was stolen and there are no know suspects. Thus, D=17, G=1, and U=0.

The effort used to transport evidence away from a suspected map point is the ratio of A to K and may be compared to the distance from a suspected map point 501 to the crime scene 520. Minimum relative effort may be assumed to indicate a more relaxed suspect, while extreme effort may indicate a more agitated suspect. By assuming a minimum effort, the quotients of A/K equal to one or close to one may be more likely to indicate the location of a suspect's residence than other relative effort quotients.

In this example, A is approximately 21.5 km and K is approximately 13 km. A/K is 1.65, which may be considered statistically high and not logical criminal behavior owing to a suspect's instinct to attempt to lead investigators away. In this map point example, by placing the evidence in between the crime scene 520 and the map point 501, a detective may be directed toward this map point counter to typical human behavior, which lowers the rating for the map point 501.

The economic ratio of stolen property value given in thousands of dollars (Pv) is divide by the economic rating or nature of the map point (P). The economic rating of a map point may be given 1 to 10 points with 1 being the lowest class and 10 being the most upper class. Pv/P=0.032/9=0.00356, in this case the ratio of 1 to 280 (1/0.00356) the most significant number that may be used is J=280. If no property is involved, the 1 may indicate the suspect's perceived gain.

Variable E is not necessary in this example but is valuable information when searching for the last known owner as a suspect, or in forming "time to crime" statistical models. The time clapsed since the crime may calm a suspect and make the suspect more likely to make a mistake and relates to the emotional state of the suspect. This value may be in years. If the crime occurred 36 hours ago, Q−M=(1/365)×1.5=0.0027×1.5=0.004 years. This relatively small amount of time has little effect, (A/K)−(Q−M)=1.65−0.004=1.646.

Additional distance comparison is performed by (A+C)/(C+K), in this case C is not used and A/K is used again as a mediator. AB squared is simplified to A squared as B is omitted in this example. A is squared to produce an exaggeration for comparison to variable O. $A^2=21.5^2=462.25$. The variable O is the mean distance from the map point 201 at which the distance to each intersection of the crime scene and other data points overlapped perimeter areas longitudinal axis extensions are all equal. In this example, point D.25,6.5 is a close estimation of the location from which O may be measured. The distance from point A,1 to D.25,6.5 is approximately 12.5 km. Points producing values for O which are closest to zero are considered more likely areas in which the suspect may be found. The economic rating ratio J is also indicative of a suspect's means to escape and their emotional state.

In this example, I may be determined from the following equation:

$$I = \frac{(A/K) - (Q - M) + A/K + (A^2/(J - O)) + J}{D + G + U}$$

$$I = \frac{(1.65 - 0.004) + 1.65 + (462.25/(280 - 12.5)) + 280}{(17 + 1 + 0)} = \frac{285.02}{18} = 15.83$$

On a point scale of 1 to 100, this value for I may seem rather low, however, the upper range of I may mainly be reached by seriously deranged serial killers who may commit the type of crime five or six times, or a murder suspect who involves violence far exceeding the requirements of their apparent objective.

To determine the relative probability R that the suspect resides at a particular map point and to apply all available data to each individual map point, only variable for which values are available need be employed. In this example R may be determined from the following equations:

$$R = \frac{((A/O/I) + (I + (K/O + G + U)) + AKO + ((A(EF + T)/(I - (G + H) + G)) - (E + N) - (Q - M)D}{J/(A + K) + ((A/O) + H)/I - E) + (O/I - 1) + (E/D) - (P(Q + F))}$$

$$R = \frac{\dfrac{\left(\dfrac{21.5 + 13}{280} + \dfrac{21.5}{12.5} + 0.008\right)}{15.83} - 1 + \dfrac{12.5}{15.83} - 1 + \dfrac{0.008}{17} - 15.83 - \dfrac{1 + 0.008}{9(12 + 3)} + 1}{\dfrac{21.5/12.5}{15.83} + 15.83 + \dfrac{13}{12.5} + 1 + 0 + (21.5)(13)(12.5) + \dfrac{21.5(3 - 0)}{15.83 - 1 + 0.008 + 1} - (1 + 0.004 - 0.004)(17)} = 9015.56$$

On a point scale of 1 to 1,000,000, this value for R indicates a less than one percent chance of locating the suspect at point 501. Each point is analyzed on the map and a probability map is displayed (FIG. 34).

From these relationships, probability areas may be plotted. Area 550 indicates the least likely location of the suspect at the time of the plotting. Area 552 indicates a less likely search area for the suspect. Area 554 indicates an approximately 40% probability of locating the suspect in this area. Area 556 indicates an approximately 60% probability of locating the suspect in this area. Area 558 indicates a more likely area to find the suspect. Area 560 indicates the most likely area to find the suspect. And location 562 indicates the likely location of the suspect.

Having thus described the invention, what is claimed as new and desired to be secured by Letters Patent is as follows:

1. A method for identifying a firearm having a bore with a barrel and breech from which a bullet is fired, said method comprising the steps of:

(a) entering identifying data into a computer system to identify said firearm, (b) storing said identifying data, (c) encoding said identifying data, (d) etching said encoded data into said bore of said firearm, (e) transferring said encoded data from said barrel to a surface of a slug of a bullet upon firing said bullet from said firearm, (f) transferring said encoded data from said breech to a surface of a casing of said bullet upon firing said bullet, (g) scanning said encoded data on said slug and/or casing, (h) decoding said encoded data scanned from said slug and/or casing to provide decoded data, and (i) comparing said decoded data with said stored identifying data whereby to identify said firearm from which said bullet was fired.

2. The method as claimed in claim 1 further comprising the steps of:

entering registration data into said computer system indicative of an owner of said firearm;

coupling said identifying data with said registration data, and identifying said owner of said firearm from said decoded data.

3. The method as claimed in claim 1 wherein said step (d) includes inserting a laser etching probe into said barrel of said bore, and emitting a laser energy from said probe in response to said encoded data.

4. The method as claimed in claim 3 wherein said step further includes etching said encoded data in said barrel generally parallel to a rifling in said barrel.

5. The method as claimed in claim 1 wherein said step (d) includes inserting a laser etching probe into said breech of said bore and emitting a laser energy from said probe in response to said encoded data.

6. The method as claimed in claim 5 wherein said step further includes etching said encoded data in said breech generally parallel to a longitudinal axis of said bore.

7. An apparatus for etching the barrel and breech of the bore of a firearm with an identifying indicia for subsequent identification of the firearm from a slug or casing of a bullet fired therefrom, said apparatus comprising:

processing means for storing registration data corresponding to an owner of said firearm and identifying data indicative of said firearm and comparing input data therewith, means for encoding said identifying data, means for etching said encoded identifying data in said barrel of said firearm, whereby a slug of a bullet fired from said firearm will have markings corresponding to said encoded data transferred to a surface of said slug from said etched barrel, means for etching said encoded identifying data in said breech of said firearm, whereby a casing of a bullet fired from said firearm will have markings corresponding to said encoded data transferred to a surface of said casing from said etched breech, and means for reading said markings and transferring said read data to said processing means for comparison with identifying data stored therein, whereby to identify the firearm from which the bullet was fired.

8. The apparatus as claimed in claim 7 wherein said processing means includes means for transferring said registration data and said identifying data to a central database.

9. The apparatus as claimed in claim 7 wherein said encoded data is a bar code.

10. The apparatus as claimed in claim 7 wherein said encoded data is a plurality of spaced-apart grooves.

11. The apparatus as claimed in claim 7 wherein said means for etching said encoded identifying data in said barrel includes inserting a laser probe into said barrel and emitting a laser to etch a plurality of grooves on the surface of the barrel generally parallel to a rifling in said barrel.

12. The apparatus as claimed in claim 11 wherein said probe includes a focusing mirror.

13. The apparatus as claimed in claim 11 wherein said probe includes a coolant.

14. The apparatus as claimed in claim 7 wherein said means for etching said encoded data in said breech includes inserting a laser probe into said breech and emitting a laser to etch a plurality of grooves into the surface of said breech generally parallel to a longitudinal axis of said bore.

15. The apparatus as claimed in claim 14 wherein the depth of said grooves taper from a first end to a second end of said breech.

16. The apparatus as claimed in claim 14 wherein said probe includes a focusing a mirror.

17. The apparatus as claimed in claim 16 wherein said probe includes a coolant.

18. The apparatus as claimed in claim 7 wherein said means for etching includes inserting a probe into a first end of said bore, inserting a laser into a second end of said bore and focusing said laser on the surface of said bore.

19. The apparatus as claimed in claim 7 wherein said etching means comprises:

a laser etching assembly having a frame, a laser etching tube, and a laser etching tube support member, said laser etching tube rotatably secured to said laser etching tube support member, said laser etching tube support member slidably secured to said frame, said laser etching tube having a laser probe for directing a laser beam from a laser tube at the surface of said bore, a first stepper motor for controlling the linear movement of said laser etching tube, a second stepper motor for controlling rotation of said laser etching tube, and a microprocessor for controlling said stepper motors and laser beam output from said laser tube whereby said processor directs movement of said probe in said bore of said firearm in a predetermined pattern in coordination with laser output of said laser tube to etch said encoded data on the surface of said bore.

20. The apparatus as claimed in claim 19 wherein said etching means further comprises a firearm clamping means for securing said firearm in axial alignment with said laser probe.

21. The apparatus as claimed in claim 19 wherein said etching means further comprises a firearm clamping assembly for securing said firearm in axial alignment with said laser probe and having an alignment assembly and a barrel clamp releasably mounted to said alignment assembly, said alignment assembly having a clamp adjustment slide coupled to a third stepper motor to adjust the linear position of said barrel clamp in response to control signals from said microprocessor.

22. An apparatus for etching the bore of a firearm with an identifying indicia for subsequent identification of the firearm from a bullet fired therefrom, said apparatus comprising:

a laser etching assembly having a frame, a laser etching tube, and a laser etching tube support member, said laser etching tube rotatably secured to said laser etching tube support member, said laser etching tube support member slidably secured to said frame, said laser etching tube having a laser probe for directing a laser beam from a laser tube at the surface of said bore, means for controlling the linear and rotational movement of said laser etching tube to etch the barrel of said bore generally parallel to the rifling of said barrel and to etch the breech of said bore generally parallel to the longitudinal axis of said bore, and a microprocessor for directing said controlling means and said laser beam output from said laser tube whereby said processor directs movement of said probe in said bore of said firearm in a predetermined pattern in coordination with said laser output of said laser tube to etch said encoded data on the surface of said bore.

23. An apparatus for scanning a slug or casing of a bullet with identifying indicia for subsequent identification of the firearm from which the bullet was fired, said apparatus comprising:

a light source for illuminating the identifying indicia, a detector for receiving reflections of said light source from said identifying indicia, means for securing said slug or said casing for scanning, an ammunition rotator tip secured to said rotating means for rotating said slug or casing relative to said light source and detector, and a microprocessor for decoding said identifying indicia received from said detector for subsequent identification of said firearm.

24. The apparatus as claimed in claim 23 wherein said ammunition rotator tip includes a plurality of fingers.

25. The apparatus as claimed in claim 23 further comprising a GPS receiver for receiving GPS data to identify the current location of said scanner.

26. The scanner as claimed in claim 25 further comprising a cellular transmitter and receiver to transmit identifying indicia data corresponding to said identifying indicia and GPS data and to receive data.

27. The apparatus as claimed in claim 23 wherein said scanner is portable.

28. The scanner as claimed in claim 23 further comprising a cellular transmitter and receiver to transmit scanned data and to receive data.

29. The apparatus as claimed in claim 23 further comprising means for calculating the probable location of a criminal suspect based on crime scene data, firearm identifying data, firearm registration data and location data.

30. The apparatus as claimed in claim 29 further comprising graphically displaying the probable locations of a criminal suspect.

31. The apparatus as claimed in claim 30 further comprising overlaying said graphical display of said probability on an electronic map.

* * * * *